US007311219B1

(12) United States Patent
Kallas et al.

(10) Patent No.: US 7,311,219 B1
(45) Date of Patent: Dec. 25, 2007

(54) ADJUSTABLE GRID PAINT PAN

(75) Inventors: Matthew R. Kallas, Goodyear, AZ (US); Toby L. Edwards, Mesa, AZ (US)

(73) Assignee: KK Edwards, LLC, Folsom, CA (US)

( * ) Notice: Subject to any disclaimer, the term of this patent is extended or adjusted under 35 U.S.C. 154(b) by 264 days.

(21) Appl. No.: 10/918,108

(22) Filed: Aug. 13, 2004

Related U.S. Application Data

(60) Provisional application No. 60/495,867, filed on Aug. 18, 2003, provisional application No. 60/499,217, filed on Sep. 2, 2003.

(51) Int. Cl.
*B05C 21/00* (2006.01)
*B65D 51/20* (2006.01)

(52) U.S. Cl. ..... 220/570; 15/257.05; 15/257.06

(58) Field of Classification Search ..... 220/570; 15/257.05, 257.06
See application file for complete search history.

(56) References Cited

U.S. PATENT DOCUMENTS 2,490,546 A * 12/1949 Rubin ..... 15/257.06
2,778,050 A * 1/1957 Meinhardt ..... 15/248.2
2,779,960 A * 2/1957 Ogren ..... 15/257.06
2,977,624 A * 4/1961 Tarr ..... 15/257.06
4,356,588 A * 11/1982 Martucci ..... 15/257.06
6,279,194 B1 8/2001 Wakat
6,434,782 B2 8/2002 Wakat
6,471,086 B1 10/2002 Fleckenstein
2001/0036513 A1* 11/2001 Capoccia ..... 427/429

* cited by examiner

*Primary Examiner*—Anthony D. Stashick
*Assistant Examiner*—Shawn M. Braden
(74) *Attorney, Agent, or Firm*—LaValle D. Ptak

(57) ABSTRACT

A paint pan for use with a paint roller is in the form of an open topped pan with a bottom, upturned ends, and upturned sides. A movable grid is located between the sides and ends of the paint pan and is normally biased to a position located a predetermined distance above the bottom of the pan. The grid may be pressed down toward the bottom of the pan upon application of a predetermined pressure, whereupon release of the pressure allows the grid to return to the first position spaced from the bottom of the pan.

16 Claims, 4 Drawing Sheets

ADJUSTABLE GRID PAINT PAN

CROSS-REFERENCE TO RELATED APPLICATION

This application is related to and claims priority from now abandoned U.S. provisional application Ser. Nos. 60/495,867 filed Aug. 18, 2003 and 60/499,218 filed Sep. 2, 2003.

BACKGROUND

Open top paint pans for use with paint rollers have challenged professional painters and laymen alike for many years. The basic problem has been that the paint roller slips and slides on the bottom of the paint pan when the roller should be rolling to properly load the roller with paint. In addition, some portions of the roller are loaded with greater quantities of paint than other portions, causing uneven application on the wall. Manufacturers have tried to address this issue by placing bumps, ridges or nipples on the bottom of the paint pan. While these efforts alleviate the problem to some extent, they do not provide a complete solution.

DETAILED DESCRIPTION

Figure 1:
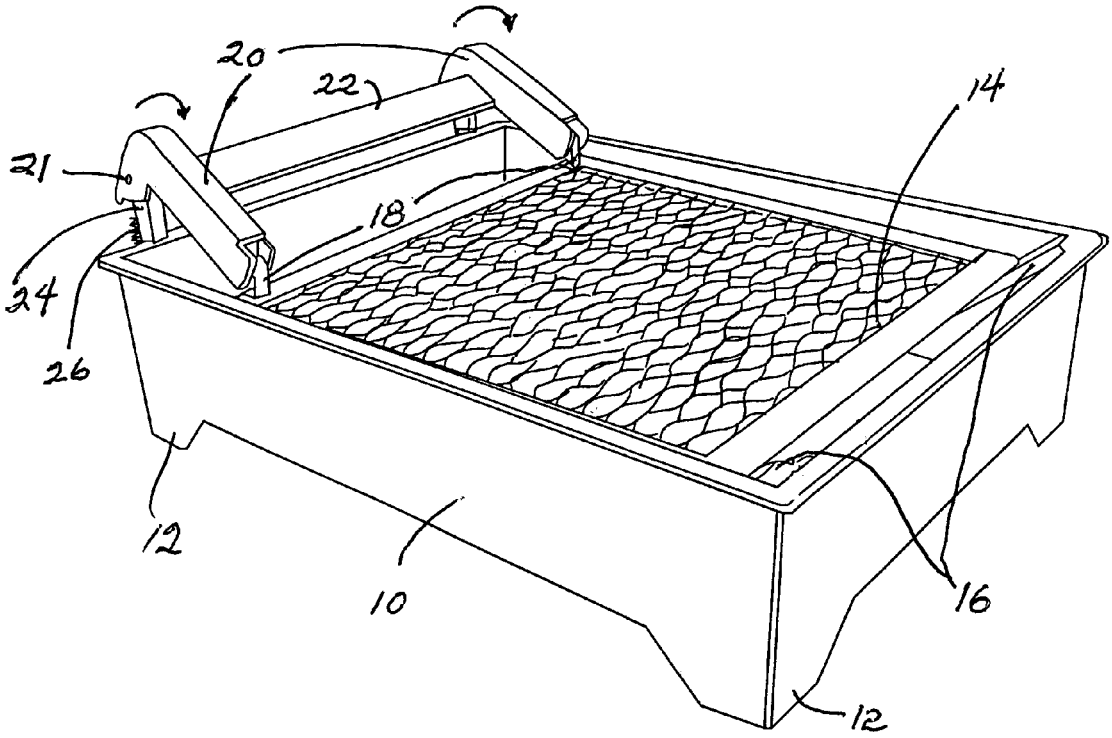
FIG. 1 is a top perspective view of an embodiment of the invention.

In the various figures of the drawing, the same reference numbers are used to designate the same or similar components. FIG. 1 is a top perspective view of an embodiment of a paint pan utilizing an adjustable grid for facilitating the even application of paint to a roller, and for facilitating the removal of excess paint from the roller. Reference first should be made to FIG. 1, which shows the basic paint pan 10 in the form of an elongated rectangular tray or pan 10 which may be made of any suitable material, such as aluminum or plastic.

The pan 10 has a flat rectangular bottom and first and second opposite ends and first and second opposite sides, which are attached at their bottom edges to the bottom of the tray and extend upwardly from it to form an open top. Each of the four corners of the tray are provided with legs 12 which assist in providing a stable platform for the tray when it is placed on a floor or other surface.

An adjustable grid 14, which also has a rectangular shape designed to substantially overlie the bottom of the tray, is normally biased to a position near the top of the tray, spaced from the bottom. The grid 14 may be in any number of forms including a perforated plate, or a screen-like configuration which has sufficient apertures through it to allow paint to drop through it back into the paint pan formed by the bottom, sides and ends described above.

In contrast with standard paint pans, which typically have a sloping bottom in them, deeper at one end and shallower at the other, the paint pan 10 illustrated in the drawings is designed with a bottom which typically is held in a horizontal position from end-to-end whenever the pan 10 is placed on a surface supported by the legs 12. The pan preferably is of uniform depth from end-to-end and from side to side.

Figure 2:
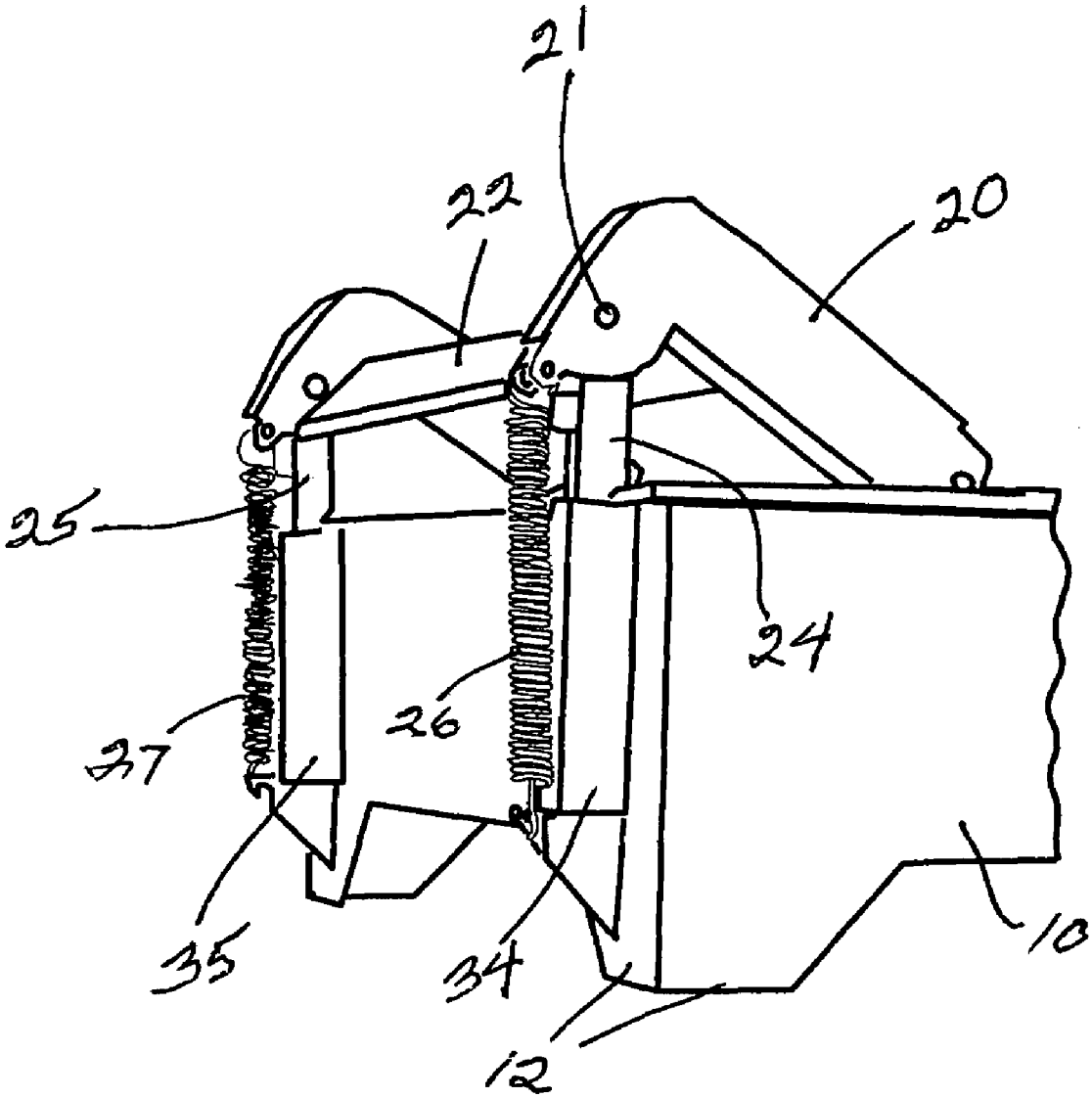
FIG. 2 is a partial rear perspective view of the embodiment of FIG. 1.
Figure 3:
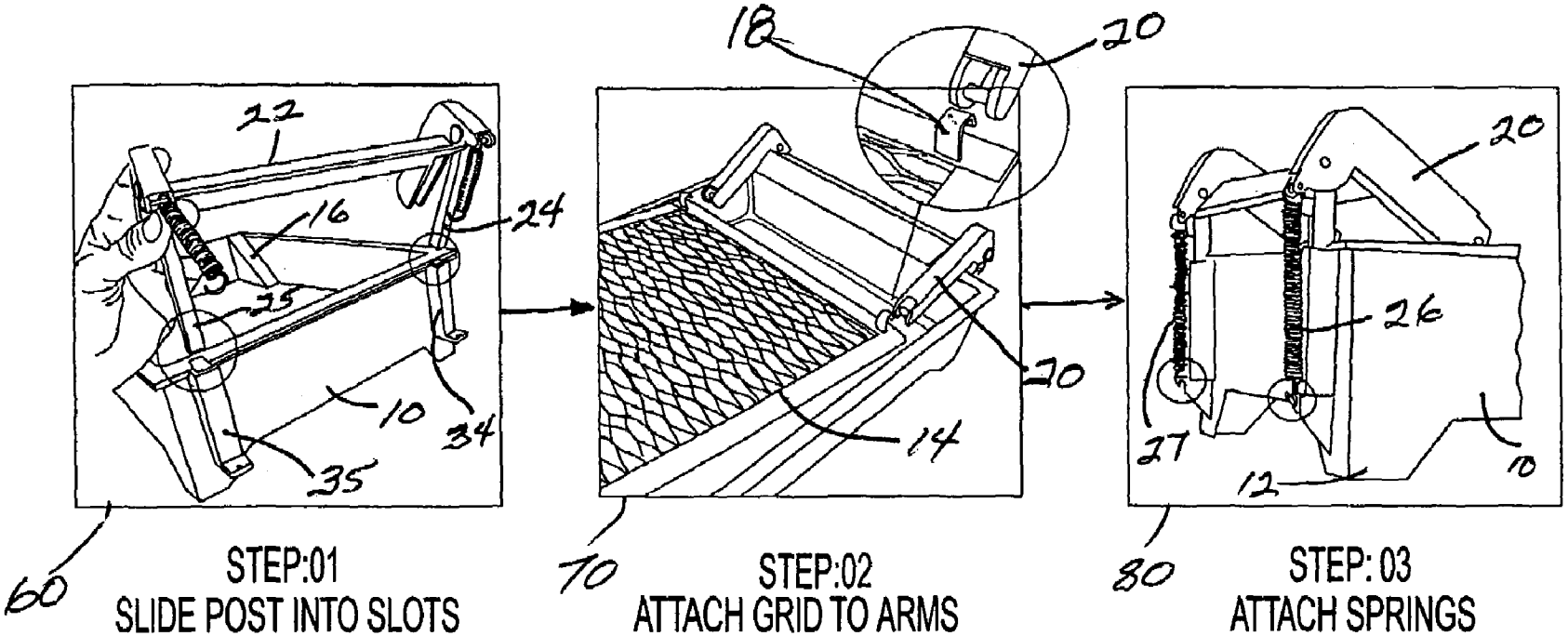
FIG. 3 is a diagrammatic flow chart illustrating details of the embodiment shown in FIGS. 1 and 2.

As illustrated in FIGS. 1, 2, and 3, the grid 14 is supported at its left-hand end (as viewed in FIG. 1) on a pivot assembly by a pair of hooks 18. The pivot assembly includes two spaced pivot arms 20 tied together by a bar 22 and pivoting on pivots 21 extending into the top ends of vertical posts 24 and 25 inserted into channels 34 and 35, respectively, on the outside of the left-hand end of the paint pan, as illustrated on FIGS. 1 and 2. Normally, the arms 20 are pivoted in the counterclockwise direction (as viewed in FIGS. 1 and 2) against a stop to hold or bias the movable grid plate 14 in its uppermost position near the upper edges of the sides and ends of the pan 10, as illustrated in FIG. 1. This is accomplished under the force of a pair of coil springs 26 and 27, which are attached to the left-hand or short ends of the arms 20 and to hooks at the lower ends of the channels 34 and 35, as illustrated most clearly in FIG. 2. The tension of the springs 26 and 27 establishes a predetermined biasing force which is to be overcome in order to press the movable grid 14 downwardly toward the flat bottom of the paint pan 10.

It should be noted that when the grid 14 is pressed downwardly, the arms 20 rotate in the direction of the arrows shown in FIG. 1 to cause the right-hand end of the arms 20 to rotate downwardly and toward the left-hand end wall of the paint pan 10 as the rotation increases. In order to hold the movable grid 14 in a horizontal position or in a position parallel to the bottom of the pan, throughout the downward travel of the grid 14, a pair of angled guide rails 16 are provided on the inside of the right-hand end of the paint pan. The angle of these guide rails 16 is selected to cause the right-hand end of the movable grid 14, as it moves down and slightly toward the left, to maintain that end parallel to the left-hand end attached to the ends of the pivot arms 20. Although the guide rails 16 maintain the desired parallelism of the grid 14 reasonably well when a constant slope or angle is employed, a concave curvature of the guide rails 16 matched to the rotated path of travel of the ends of the arms 20 provides even better parallel travel of both ends of the grid 14.

The relative dimensions of the paint pan shown in FIGS. 1 and 2 are selected to permit the movable grid 14 to be pressed downwardly into contact with the bottom of the pan, or nearly into contact with the bottom of the pan. As is readily apparent from an examination of the enlarged portion of Step 70 in FIG. 3 showing the assembly steps of the pan, the movable grid 14 is readily lifted out of the paint pan by lifting the hooks 18 from the corresponding pivots at the end of the arms 20.

In order to use the paint pan 10, the movable grid 14 initially is removed from the paint pan. All of the other parts are assembled as shown in FIGS. 1 and 2. In FIG. 3, a manner of removably assembling the pivot mechanism to the pan 10 is shown in Step 60. In this step, the legs 24 and 25 are permanently pivotally attached to the pivot assembly including the arms 20 and the bracket 22. The springs 26 and 27 are also attached to the short ends of the arms 20, as shown most clearly in FIG. 2 and in step 60 of FIG. 3.

The first step in assembling the paint pan is to insert the posts 24 and 25 into the corresponding channels 34 and 35 attached to the outside of the left-hand of the pan 10 as viewed in FIGS. 1 and 2 (the right-hand end as viewed in Step 60). Once the pivot arm assembly has been attached, as shown in Step 60 of FIG. 3, the movable grid 14 is releasably attached to the pivot arms 20 by means of the hooks 18 engaging short pivots in the ends of the arms 20, as shown in the enlarged section at Step 70 of FIG. 3. The next step in the assembly of the paint pan is to attach the springs 26 and 27 at their upper and lower ends to the corresponding holes or attachment hooks, which may be of any suitable type, as shown in Step 80 of FIG. 3.

After the tray has been assembled as illustrated in FIG. 3, the movable grid 14 may be removed or pivoted upwardly toward the left on the hooks 18 to allow paint to be poured into the paint pan 10 to the desired level. This level is selected to be below the upper or normal biased position of the movable grid 14; so that the grid 14 is out of contact with the paint when the grid 14 is returned to the position shown in FIG. 1, causing the right-hand end to rest on the upper ends of the guide rails 16.

To use the paint pan, the painter presses a paint roller with a downward force onto the top of the movable grid 14 to overcome the bias of the springs 26 and 27, pushing the grid down by rotating the pivot arms 20 in the direction of the arrows shown in FIG. 1 and causing the right-hand end (as viewed in FIG. 1) of the movable grid 14 to slide downwardly and toward the left, or toward the pivot arm end. While maintaining this downward pressure, the paint roller then can be rolled across the grid 14 loading the roller with paint, since the grid is pressed downwardly into the paint to the desired level. The length of the grid 14 is designed to assure that the paint roller which is to be used with the paint pan 10 will roll at least one complete revolution. This allows the paint roller to be properly loaded with as little as one revolution of movement.

After the paint roller has been properly loaded, it is lifted and pressure on the grid 14 is relaxed. The springs 26 and 27 pivot the arms 20 in a counterclockwise direction, opposite the direction of the arrows shown in FIG. 1. This lifts the grid 14 back to its rest or normal position above the paint in the pan 10. With the grid in its original position, a paint roller can be rolled lightly on the grid 14 to remove any excess paint. This process is repeated for reloading the roller with paint, and then removing excess paint until the paint in the reservoir in the pan 10 is depleted, whereupon it can be replenished.

The retraction/pressure of the grid 14 is created by the springs 26 and 27 which hold the grid in place; and the grid 14 is kept level by the guide rails 16 on the opposite end of the pan 10. It should be noted that a desirable design is to have the bottom of the pan 10 horizontal or level and the movable grid 14 also in a horizontal plane throughout its movement from the position shown in FIG. 1 to the lowermost position which can be reached by the grid 14. This assures the most even application of paint to the roller, and the most uniform removal of excess paint. The movable grid 14 is designed to maintain the plane of the grid 14 parallel to the plane of the bottom of the pan 10 for best results.

Figure 4:
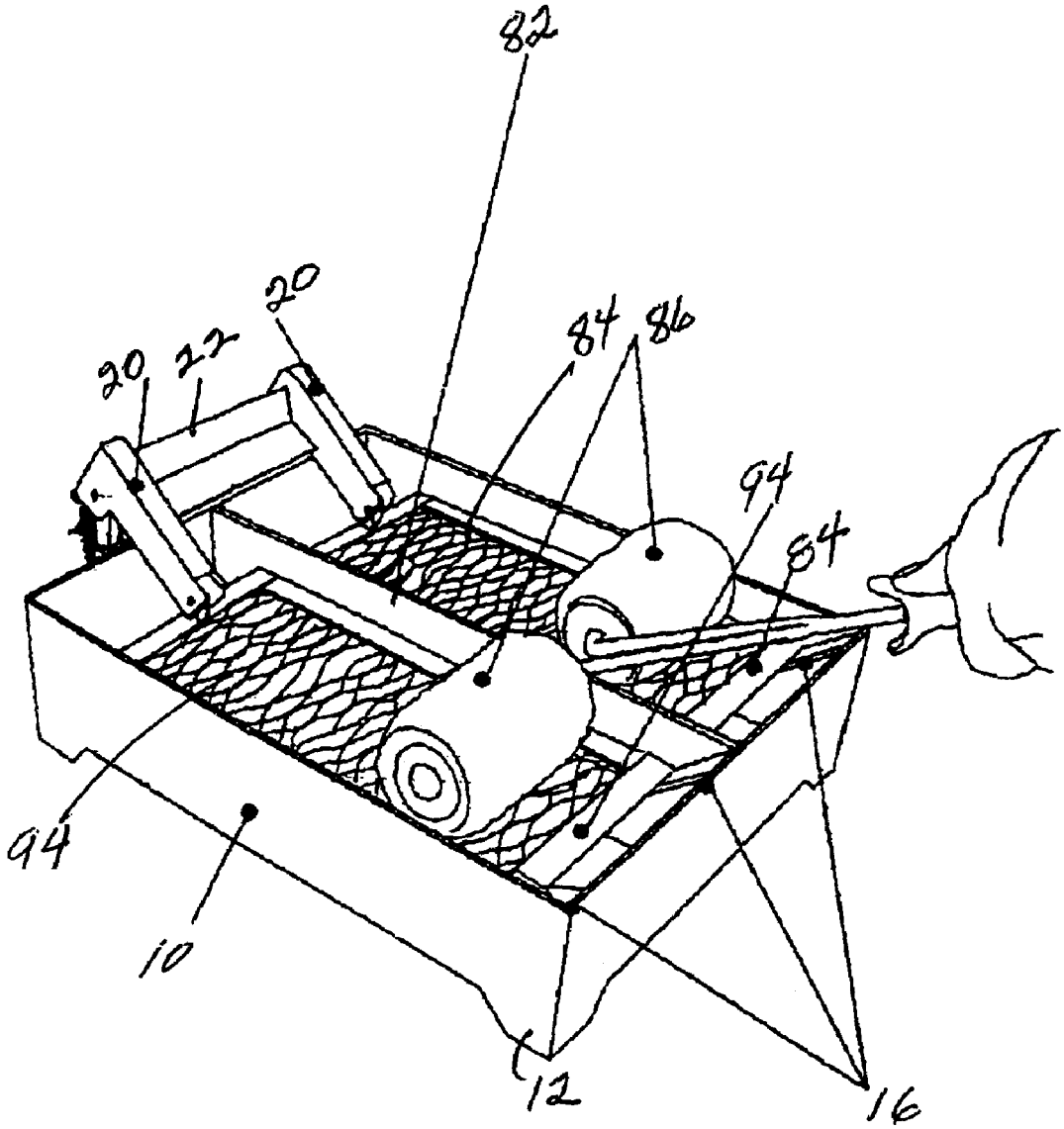
FIG. 4 is a top perspective view of another embodiment of the invention.

FIG. 4 illustrates an alternative embodiment of the invention. The paint pan 10 in the embodiment of FIG. 4, however, is divided lengthwise substantially at its middle by a wall or partition 82, which is parallel to the first and second opposite sides of the paint pan 10. The partition 82 is attached to both of the opposite ends and to the bottom of the pan 10 to form two separate reservoirs for paint in a single pan. Instead of a single movable grid, such as the movable grid 14, two movable grids 84 and 94 are provided for each of the separate compartments formed in the paint pan 10 of FIG. 4. The grids 84 and 94 are attached substantially at the centers of one end to each of the two different arms 20 of the pivot mechanism, and slide on guide rails 16 (with additional guide rails on each side of the wall 82, as illustrated in the right-hand end of FIG. 4). In all other respects, the paint pan 10 of FIG. 4 operates in the same manner as the one described above in conjunction with FIGS. 1 and 2; and assembly of the paint pan 10 is the same as described in conjunction with the diagrammatic flow chart of FIG. 3.

The paint pan of FIG. 4 allows the pan to have two different colors of paint placed in the two different compartments, if desired, for application by a narrower rollers such as the rollers 86 shown in FIG. 4. It also is possible to have a bifurcated roller operating off a single handle, with the two different parts 86 as shown in FIG. 4, if for some reason such a tool with its corresponding pattern of paint application would be desirable.

It would should be noted in conjunction with the embodiments which have been described that paint pan liners may be used with the paint pans of both FIGS. 1 and 4. This facilitates cleaning of the paint pan 10 to the same extent as for liners used with conventional paint pans. In addition, however, liners may extend the life of the paint pan 10, since the movable grid 14, or 84 and 94, will slide on corresponding portions of removable paint pan liner, rather than directly on the guide rails 16 formed into the pan itself. This may extend the life of the paint pan 10 because the paint pan itself will not become worn from the sliding action of the grids 14, 84 or 94 sliding up and down on the guide rails 16. Obviously, any paint pan liner, manufactured to follow the general contours of the inside of the paint pan 10, can be used as is commonly done with paint pans of other configurations.

Although aluminum and plastic have been mentioned for the fabrication of the paint pan 10 and of the movable grid 14, other materials also may be readily suited for fabricating any of these parts without changing the operating characteristics of the disclosed embodiments in any way. It should be noted that the embodiments which have been disclosed are not to be considered as limiting, but rather are illustrative of the invention. Various changes and modifications will occur to those skilled in the art for performing substantially the same function, in substantially the same way, to achieve substantially the same result without departing from the true scope of the invention as defined in the appended claims.

What is claimed is:

1. A pan for use with a paint roller including in combination: a paint pan having a bottom, first and second upturned ends and first and second upturned sides, with an open top for holding a quantity of paint therein; a movable grid member having first and second ends and located between the ends and the sides of the paint pan, the movable grid member being normally biased to a first position a predetermined distance from the bottom of the paint pan; a pivot arm assembly attached to the first end of the paint pan; and a return spring located at all times entirely outside the paint pan and coupled between the pivot arm assembly and the paint pan, with the first end of the movable grid member attached to the pivot arm assembly to permit the movable grid member to the moved downwardly toward the bottom of the paint pan upon application of a predetermined pressure to the movable grid member, whereupon the return spring returns the movable grid member through operation of the pivot arm assembly to the first position upon release of the predetermined pressure.

2. A pan according to claim 1 wherein the movable grid member is in the form of a flat rectangle and the paint pan has a rectangular configuration.

3. A pan according to claim 2 wherein the movable grid member moves in planes parallel to the plane of the bottom of the paint pan.

4. A pan according to claim 2 wherein the first position of the movable grid member is selected to be located entirely above the top of the highest level of paint located within the paint pan.

5. A pan according to claim 4 wherein the second end of the movable grid member moves on angled guide rails attached to the second end of the paint pan.

6. A pan according to claim 5 wherein the pivot arm assembly moves the first end of the grid member downwardly and toward the first end of the paint pan as pressure in excess of the predetermined pressure is applied to the grid member, whereupon the second end of the grid member slides downwardly on the angled guide rails toward the first end of the paint pan to maintain the orientation of the grid member in parallel planes to the plane of the bottom of the paint pan.

7. A paint pan according to claim 6 wherein the guide rails slope inwardly from the top of the second end toward the bottom of the paint pan.

8. A pan according to claim 7 further including a first spring attachment member located near the bottom of the paint pan at the first end thereof and a second spring attachment member on the pivot arm assembly, and wherein the spring comprises at least one spring attached between the first and second spring attachment members for normally biasing the movable grid member to the first position with a predetermined force determined by the parameters of the spring.

9. A pan according to claim 1 wherein the bottom of the paint pan is a flat rectangular member and the grid member is a flat rectangular member having dimensions slightly less than the dimensions of the bottom of the paint pan.

10. A pan according to claim 9 wherein the movable grid member moves in planes parallel to the plane of the bottom of the paint pan.

11. A pan according to claim 10 wherein the first position of the movable grid member is selected to be located entirely above the top of the highest level of paint located within the paint pan.

12. A pan according to claim 1 further including angled guide rails attached to the second end of the paint pan, wherein the guide rails slope inwardly from the top of the second end toward the bottom of the paint pan and the second end of the grid member moves on the angled guide rails.

13. A pan according to claim 12 wherein the pivot arm assembly moves the first end of the grid member downwardly and toward the first end of the paint pan as pressure in excess of the predetermined pressure is applied to the grid member, whereupon the second end of the grid member slides downwardly on the angled guide rails toward the first end of the paint pan to maintain the orientation of the grid member in parallel planes to the plane of the bottom of the paint pan.

14. A pan according to claim 1 wherein the first position of the movable grid member is selected to be located entirely above the top of the highest level of paint located within the paint pan.

15. A pan according to claim 1 wherein the movable grid member moves in planes parallel to the plane of the bottom of the paint pan.

16. A pan according to claim 1 further including an intermediate partition extending between the first and second ends of the paint pan and parallel to the first and second sides to divide the paint pan into the two paint-holding sections, and wherein the movable grid member comprises first and second movable grid members located, respectively, between the first side and the partition and between the partition and the second side of the paint pan, with the first and second movable grid members each normally biased to a first position a predetermined distance from the bottom of the paint pan, and wherein the spring is coupled between the first and second movable grid members in the paint pan to permit the movable grid members to be moved downwardly toward the bottom of the paint pan upon application of predetermined pressure to each of the movable grid members individually, whereupon each of the first and second movable grid members returns to the first position upon release of the predetermined pressure.

* * * * *